US009543666B2

(12) United States Patent
Wendt

(10) Patent No.: US 9,543,666 B2
(45) Date of Patent: Jan. 10, 2017

(54) CLAMPING ELEMENT HAVING TWO LEVER ARMS TO CLAMP A CONDUCTOR AGAINST A BUSBAR

(71) Applicant: PHOENIX CONTACT GMBH & CO. KG, Blomberg (DE)

(72) Inventor: Andreas Wendt, Berlin (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/783,440

(22) PCT Filed: Apr. 16, 2014

(86) PCT No.: PCT/EP2014/057773
§ 371 (c)(1),
(2) Date: Oct. 9, 2015

(87) PCT Pub. No.: WO2014/170388
PCT Pub. Date: Oct. 23, 2014

(65) Prior Publication Data

US 2016/0056548 A1 Feb. 25, 2016

(30) Foreign Application Priority Data

Apr. 19, 2013 (DE) ..... 10 2013 006 739

(51) Int. Cl.
*H01R 4/28* (2006.01)
*H01R 4/50* (2006.01)

(52) U.S. Cl.
CPC ..... *H01R 4/28* (2013.01); *H01R 4/5008* (2013.01); *H01R 4/5075* (2013.01)

(58) Field of Classification Search
CPC ..... H01R 4/50; H01R 4/5008; H01R 9/24; H01R 9/2408
USPC ..... 439/725, 806
See application file for complete search history.

(56) References Cited

U.S. PATENT DOCUMENTS 6,134,774 A * 10/2000 Williams ..... H01R 4/5033 29/278
6,341,989 B1 * 1/2002 Jaag ..... H01R 4/4827 439/725
8,062,077 B2 * 11/2011 Hayashi ..... H01R 4/4863 439/725

(Continued)

FOREIGN PATENT DOCUMENTS

CH 391034 A 4/1965
DE 3822980 A1 1/1990

(Continued)

*Primary Examiner* — Chandrika Prasad
(74) *Attorney, Agent, or Firm* — Leydig, Voit & Mayer, Ltd.

(57) ABSTRACT

A connecting terminal includes a receiving body, a clamping element configured to clamp a conductor inserted into the connecting terminal against a busbar arranged in the connecting terminal, a first lever arm rotatably mounted on the clamping element, and a second lever arm rotatably mounted on the first lever arm. The second lever arm has an actuation region by way of which the second lever arm can be pivoted. The clamping element can be moved by the first lever arm into a clamping position and into a non-clamping position when the second lever arm is pivoted.

8 Claims, 4 Drawing Sheets

(56) References Cited

U.S. PATENT DOCUMENTS

| | | | | |
|---|---|---|---|---|
| 8,129,641 | B2 * | 3/2012 | Majewski | H01R 4/4845 200/335 |
| 8,192,095 | B2 * | 6/2012 | Kortan | B60S 1/0881 156/221 |
| 9,240,650 | B2 * | 1/2016 | Wu | H01R 4/48 |
| 2014/0134892 | A1 | 5/2014 | Wendt | |
| 2015/0380837 | A1 * | 12/2015 | Kollmann | H01R 4/4836 439/721 |

FOREIGN PATENT DOCUMENTS

| | | | |
|---|---|---|---|
| DE | 29807956 | U1 | 7/1999 |
| WO | WO 2013004343 | A | 1/2013 |

* cited by examiner

CLAMPING ELEMENT HAVING TWO LEVER ARMS TO CLAMP A CONDUCTOR AGAINST A BUSBAR

CROSS REFERENCE TO RELATED APPLICATIONS

This application is a U.S. National Stage Application under 35 U.S.C. §371 of International Application No. PCT/EP2014/057773 filed on Apr. 16, 2014, and claims benefit to German Patent Application No. 10 2013 006 739.1 filed on Apr. 19, 2013. The International Application was published in German on Oct. 23, 2014 as WO 2014/170388 A1 under PCT Article 21(2).

FIELD

The invention relates to a connecting terminal having toggle lever actuation.

BACKGROUND

A connecting terminal having toggle lever actuation is known from DE 298 07 956 U1, for example, and comprises a housing, inside which a fixed connecting contact is formed. Furthermore, the connecting terminal has a clamping spring having a first leg, which is arranged on the connecting contact in a supporting manner, and a free spring leg which transitions into a clamping end by means of a bending knee, wherein the clamping end comprises a clamping edge which engages under the connecting contact. An actuating member which acts on the spring leg of the clamping spring is pivotally mounted in the housing and, when in a clamping position, releases the spring leg such that the clamping edge of the clamping end of said spring leg pulls a conductor, which has been inserted into the housing, against the connecting contact, and, when in an open position, presses the spring leg down so that the clamping edge is raised from the connecting contact in order to insert a conductor. The actuating element has a first lever arm and a second lever arm, wherein the first lever arm is pivotally fixed to the second lever arm. A free end of the first lever arm is pivotally mounted in the housing and a free end of the second lever arm is coupled to the spring leg. A disadvantage of this connecting terminal is the need for greater installation space. In addition, assembling such a connecting terminal is associated with high effort and costs.

SUMMARY

According to an embodiment, a connecting terminal is provided. The connecting terminal includes a receiving body, a clamping element configured to clamp a conductor inserted into the connecting terminal against a busbar arranged in the connecting terminal, a first lever arm rotatably mounted on the clamping element, and a second lever arm rotatably mounted on the first lever arm. The second lever arm has an actuation region by which the second lever arm can be pivoted. The clamping element can be moved by the first lever arm into a clamping position and into a non-clamping position when the second lever arm is pivoted.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
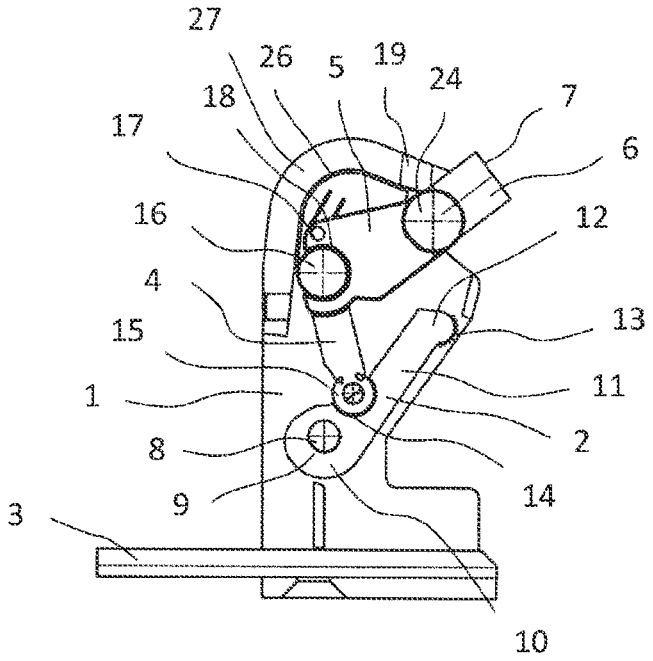
FIG. 1 is a schematic view of a first position of a connecting terminal according to an embodiment of the invention having a receiving body which is open on one side.
Figure 2:
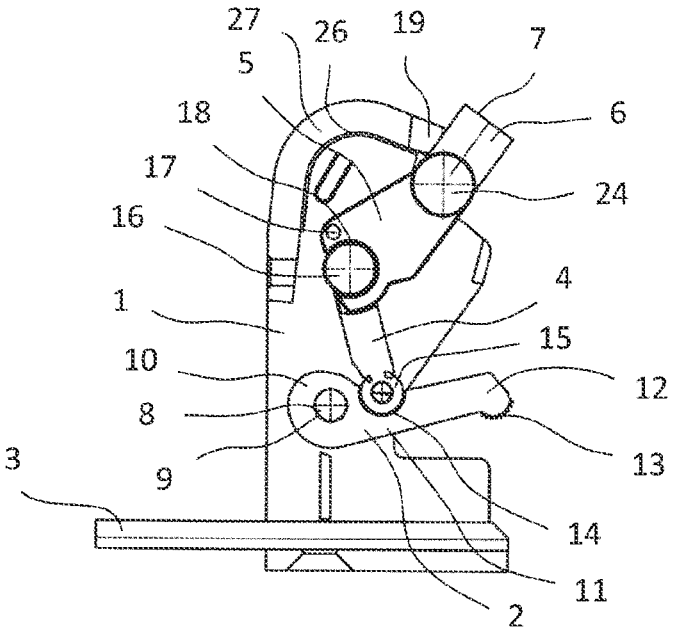
FIG. 2 is a schematic view of a second position of a connecting terminal according to an embodiment of the invention having a receiving body which is open on one side.
Figure 3:
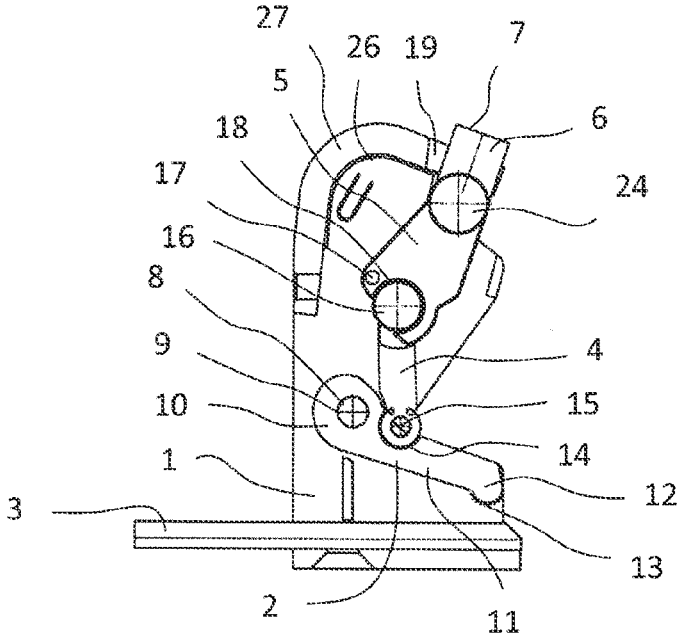
FIG. 3 is a schematic view of a third position of a connecting terminal according to an embodiment of the invention having a receiving body which is open on one side.

In an embodiment, the invention provides a connecting terminal by means of which disadvantages of prior art connecting terminals can be overcome.

In an embodiment, the invention provides a connecting terminal that includes a receiving body, a clamping element by means of which a conductor inserted into the connecting terminal can be clamped against a busbar arranged in the connecting terminal, a first lever arm which is rotatably mounted on the clamping element, and a second lever arm which is rotatably mounted on the first lever arm, wherein the second lever arm has an actuation region by means of which the second lever arm can be pivoted, wherein the clamping element can be moved by the first lever arm into a clamping position and into a non-clamping position when the second lever arm is pivoted.

A connecting terminal according to an embodiment of the invention is characterised by a toggle lever actuation means which is simple to assemble on account of its simple design and only requires a small amount of installation space when assembled. A conductor inserted into the connecting terminal is clamped against a busbar, which is inserted into the connecting terminal, by means of the clamping element such that contact is established. The clamping element is pivotally mounted, wherein the clamping element is movable such that it can be moved into the clamping position and into the non-clamping position by means of the two lever arms which form the toggle lever actuation means. The two lever arms apply the clamping force of the clamping element which is required in order to clamp a conductor against the busbar when in the clamping position. An additional spring element is not required for this purpose. The first lever arm is directly connected to the clamping element by its first end, in that the first lever arm is rotatably mounted on the clamping element. A second end, which is opposite the first end, of the first lever arm is rotatably mounted on a first end of the second lever arm. The second lever arm is therefore preferably indirectly connected to the clamping element. The second lever arm has an actuation region which is at a second end opposite the first end and by means of which the second lever arm can be moved in a pivot movement by a user. If the second lever arm is moved in a pivot movement, the pivot movement is transmitted from the second lever arm to the first lever arm and from the first lever arm to the clamping element. The clamping element and thus the connecting terminal are therefore actuated by means of the second lever arm, which is not directly connected to the clamping element. Direct actuation of the first lever arm, which is directly connected to the clamping element as a result of the first lever arm having an actuation region, is preferably not provided. The two lever arms are preferably elongate, in the form of a bar, preferably in the form of a broader bar. When in the clamping position, the two lever arms are preferably arranged in a line such that an angle of approximately 180° is formed between the longitudinal axes of the two lever arms. When in the non-clamping position, the longitudinal axes of the two lever arms are preferably oriented at an approximately 90° angle to one another.

The actuation region can, for example, be in the form of a tool insertion opening. The tool insertion opening can, for example, be in the form of a sleeve-shaped or cylindrical depression in the second end of the second lever arm, in particular in an end face of the second lever arm in the region of the second end of the second lever arm. A tool, for example a screwdriver, can be inserted into the tool insertion opening, by means of which tool the user can directly move the second lever arm in a pivot movement. Alternatively to the actuation region being in the form of a tool insertion opening, the actuation region can, for example, also be in the form of a lever or a handle which can be formed on the second lever arm, in particular on the end face of the second lever arm in the region of the second end of the second lever arm, which lever or handle the user can directly grip in order to carry out a pivot movement without requiring a tool therefor.

The kinematics of the two lever arms and of the clamping element are preferably designed with respect to one another such that, when the clamping element is moved into the clamping position and into the non-clamping position, the second lever arm carries out a first pivot movement and the clamping element carries out a second pivot movement, the first pivot movement of the second lever arm and the second pivot movement of the clamping element being in opposite directions. If, for example, the clamping element is moved from the non-clamping position into the clamping position, the clamping element preferably carries out a downward, clockwise pivot movement towards the busbar, whereas the second lever arm preferably carries out an upward, anti-clockwise pivot movement, thus away from the busbar. If the user slips from the actuation region, the anticlockwise pivot movement of the second lever arm reduces the risk of injury to said user during movement into the clamping position, for which the user needs to apply a certain degree of force, since the movement can be carried out away from the body of the user.

In order to be able to achieve a controlled movement of the second lever arm and therefore also a controlled movement of the first lever arm during a pivot movement of the second lever arm, it is preferably provided for the receiving body to have a guide region in which the second lever arm is guided when the second lever arm is pivoted. The second lever arm is therefore preferably not mounted on the receiving body by means of a rotary pin, but merely by means of a guide region of the receiving body, wherein the guide region is formed by a wall region of the receiving body, it being possible for the wall region to extend over a transverse side and/or the two longitudinal sides of the receiving body. The guide region defines the possible pivot movement of the second lever arm, wherein the extent of the pivot movement of the second lever arm is delimited by the guide region. The second lever arm can preferably carry out a pivot movement of between 40° and 60° within the guide region, which can be formed, inter alia, by an opening in the transverse side of the receiving body. The path of the pivot movement required to actuate the connecting terminal or the second lever arm and the clamping element of the connecting terminal is thus relatively small, making handling simpler for the user. In particular, in the case of large operating forces, the second lever arm can be pressed against the terminal body or against the wall region of the terminal body, which wall region delimits the guide region, as a result of which pressure forces act on the terminal body which, unlike tensile forces, do not put a significant amount of strain on the terminal body so that the connecting terminal can guarantee high stability even in the case of large operating forces.

In order to guide the second lever arm in the guide region, the second lever arm can have a guide element which can engage in the guide region of the receiving body. The guide element can for example be in the form of one or more pins which engage in the guide region.

So that the receiving body can absorb the pressure forces arising when the second lever arm is pivoted as a result of the second lever being pressed against the terminal body, and so as to be able to reduce damage to the receiving body by the pressure forces as a result, it is preferably provided for the receiving body preferably to have a resilient region, the resilient region preferably adjoining the guide region of the receiving body. The resilient region therefore forms part of the receiving body and is thus formed by the receiving body itself. For example, the resilient region can be formed by a region of the transverse side of the receiving body, at least portions of which region are separated from the remaining part of the receiving body by two grooves which extend in parallel with one another and are formed in the two opposite longitudinal sides of the receiving body, it being possible, by separating regions, to create the resilience in the region of the receiving body which has been divided in some regions.

In order to ensure that a conductor is securely clamped by the clamping element, the clamping element can comprise a clamping arm having one or more latching lugs for clamping the inserted conductor. The clamping element can be in the form of a clamping lever, one end of which, when in the clamping position, rests on the conductor to be clamped and presses said conductor against the busbar. The end of the clamping element resting on the conductor to be clamped can be in the form of a clamping arm. In order to be able to improve the clamping effect of the clamping arm or clamping element, one or more latching lugs can be formed on the clamping arm which, in the clamping position, hook into the conductor, in particular into the insulating sheath of the conductor. This can prevent the conductor accidentally releasing from the clamp, for example the conductor being unintentionally removed from the clamp and therefore from the connecting terminal.

Furthermore, the clamping element can be pivotally mounted by means of a rotary pin arranged on the receiving body. The rotary pin can be fastened in depressions or recesses formed in the receiving body. The two lever arms are preferably not directly mounted on or attached to the receiving body by means of a rotary pin, so that only the clamping element is directly mounted on or fastened to the receiving body in the connecting terminal toggle lever kinematics formed by the two lever arms and the clamping element. The two lever arms are therefore preferably mounted on the receiving body by means of the clamping element and the guide region of the receiving body.

Figure 4:
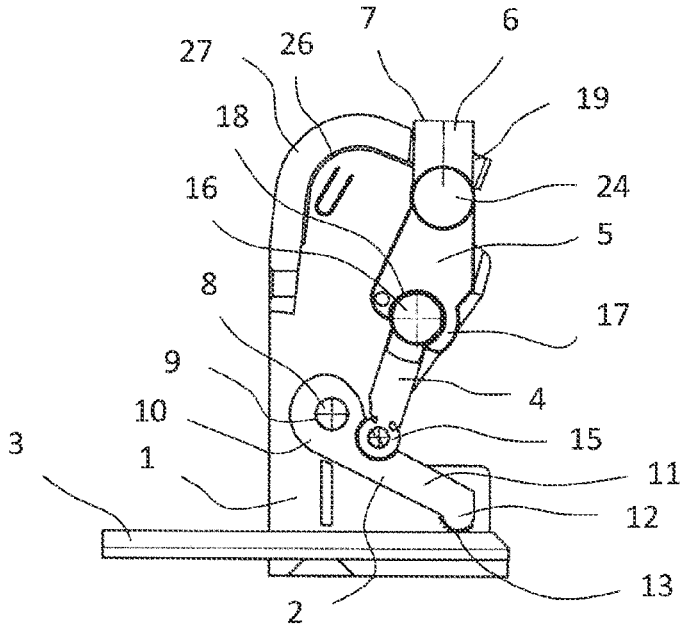
FIG. 4 is a schematic view of a fourth position of a connecting terminal according to an embodiment of the invention having a receiving body which is open on one side.

FIGS. 1 to 4 are schematic views of a connecting terminal according to the invention in various positions for moving a clamping element 2, which is arranged in a receiving body 1 of the connecting terminal and by means of which a conductor inserted into the connecting terminal can be clamped against a busbar 3 arranged in the connecting terminal, from a non-clamping position, as shown in FIG. 1, into a clamping position, as shown in FIG. 4. In this case, the receiving body 1 is shown open on one side so as to be able to illustrate the actuation of the clamping element 2 by means of the toggle lever actuation means arranged inside the receiving body 1.

The actuation of the clamping element 2 in order to move the clamping element 2 into the non-clamping position, as shown in FIG. 1, and into the clamping position, as shown in FIG. 4, is carried out by a first lever arm 4 which is rotatably mounted on the clamping element 2, and by a second lever arm 5 which is rotatably mounted on the first lever arm 4, wherein the two lever arms 4, 5 substantially form the toggle lever actuation means of the connecting terminal.

In order to actuate the clamping element 2, a user can pivot the second lever arm 5 by means of an actuation region 6 of the second lever arm 5, wherein the first lever arm 4, which is connected to the second lever arm 5, is in turn pivoted as a result of the pivot movement of the second lever arm 5 and the clamping element 2 connected to the first lever arm 4 is in turn pivoted as a result of the pivot movement of the first lever arm 4. The actuation region 6 protrudes out of the receiving body 1, at least in part, in each position shown in FIGS. 1 to 4 such that the actuation region 6 can be easily accessed by the user in every position, making handling easier for the user.

Figure 5:
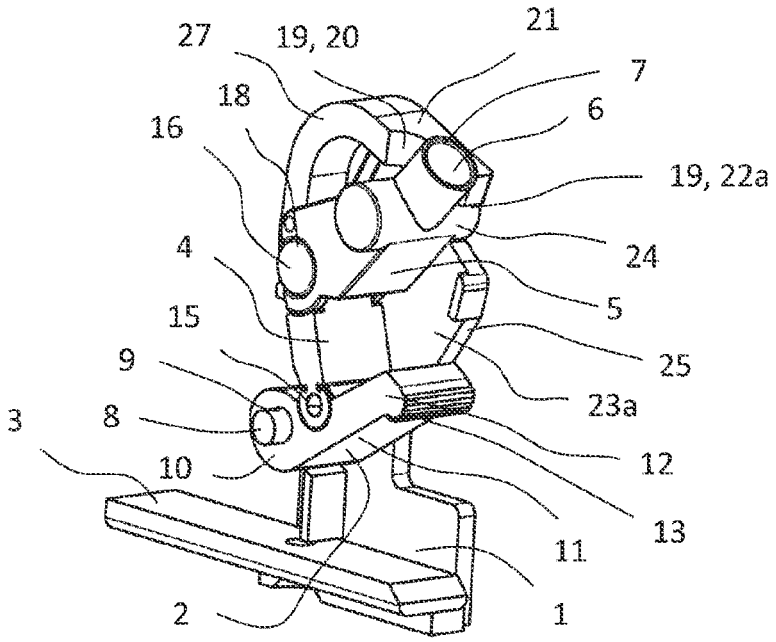
FIG. 5 is a schematic perspective view of the connecting terminal shown in FIG. 2.

The actuation region 6 is in the form of a tool insertion opening in this case, as can be seen for example in FIG. 5, wherein the tool insertion opening and thus the actuation region 6 is formed on an end face 7 of the elongate second lever arm 5. A tool, for example a screwdriver, can therefore be inserted into the second lever arm 5 in the longitudinal direction of the second lever arm 5 via the actuation region 6 in order to actuate the second lever arm 5 and therefore the connecting terminal.

The clamping element 2 and the two lever arms 4, 5 are each formed as elongate, bar-shaped elements.

The clamping element 2 is pivotally mounted by means of a rotary pin 8 arranged on the receiving body 1. Therefore, unlike the two lever arms 4, 5, the clamping element 2 is directly fastened to the receiving body 1. The clamping element 2 has a hole 9 in this region, by means of which the clamping element 2 is fastened to the rotary pin 8. The hole 9 is formed in the region of a first end 10 of the clamping element 2. A clamping arm 11 of the clamping element 2 extends from the first end 10 of the clamping element 2 and ends in a second end 12 of the clamping element 2 which is opposite the first end 10. The clamping arm 11 has a plurality of latching lugs 13 on the second end 12, which lugs are arranged on a semicircular face of the second end 12 of the clamping element 2. When the clamping element 2 is in the clamping position, the latching lugs 13 can hook into the sheath of the conductor.

In the vicinity of the first end 10 of the clamping element 2 in the region of the clamping arm 11, the clamping element 2 comprises a recess 14, preferably a substantially semicircular recess, in which the first lever arm 4 is mounted by means of a first end 15 of the first lever arm 4. In order to mount the first end 15 of the first lever arm 4 in the recess 14, the first end 15 of the first lever arm 4 is formed as a shaft which can engage in the recess 14.

The second end 16 of the first lever arm 4 opposite the first end 15 is likewise in the form of a shaft, wherein the first lever arm 4 engages, by the second end 16 thereof, in a recess 18 formed in the end 17 of the second lever arm 5 which is opposite the actuation region 6, and said first arm is rotatably mounted. The second end 16 of the first lever arm 4 engages in the recess 18 in the second lever arm 5 in both the clamping position and the non-clamping position such that the two lever arms 4, 5 are interconnected or are pivotally coupled to one another when in both the clamping position and the non-clamping position.

In addition to being mounted on the first lever arm 4, the second lever arm 5 is guided in a guide region 19 of the receiving body 1 when the second lever arm 5 is pivoted. The guide region 19 is, as shown in particular in FIGS. 5 to 8, in the form of an opening 20 in a transverse side 21 of the receiving body 1 and in the form of two opposite openings 22*a*, 22*b* in the two opposite longitudinal sides 23*a*, 23*b* of the receiving body 1. The actuation region 6 of the second lever arm 5 is guided in the opening 20 in the transverse side 21 of the receiving body 1. A guide element 24 of the second lever arm 5, which is formed in the shape of a pin in this case, is guided in the openings 22*a*, 22*b* in the longitudinal sides 23*a*, 23*b* of the receiving body 1 in that said element is rotatably mounted in the openings 22*a*, 22*b*.

In the non-clamping position, as shown in FIG. 1, the clamping element 2 is completely inserted in the inner space of the receiving body 1 in the configuration shown here. When moving from the non-clamping position into the clamping position, the clamping element 2 is pivoted downward towards the busbar 3 by its second end 12, wherein in the process the second end 12 of the clamping element 2 is guided out of the receiving body 1 via an opening 25 additionally formed in the transverse side 21 of the receiving body 1. The pivot movement of the second lever arm 5 occurs in the opposite direction to the pivot movement of the clamping element 2. When the clamping element 2 moves from the non-clamping position into the clamping position, the clamping element 2 carries out a downward, clockwise pivot movement towards the busbar 3, whereas the second lever arm 5 carries out an upward, anticlockwise pivot movement, thus away from the busbar 3. As a result of the anticlockwise pivot movement of the second lever arm 5, the second lever arm 5 is actuated by a user by means of a tool in order to move the tool required for actuation away from the body of the user. When the clamping element 2 moves from the non-clamping position into the clamping position, the clamping element 2 carries out an upward, anticlockwise pivot movement away from the busbar 3, whereas the second lever arm 5 carries out a downward, clockwise pivot movement, thus towards the busbar 3.

When moving into the clamping position and into the non-clamping position, the position of the first lever arm 4 also changes relative to the second lever arm 5, which movement forms the toggle lever actuation. In the non-clamping position, the longitudinal axis of the first lever arm 4 is arranged at a substantially 90° angle to the longitudinal axis of the second lever arm 5, as shown in FIG. 1. In the clamping position, the longitudinal axis of the first lever arm 4 is arranged at a substantially 180° angle to the longitudinal axis of the second lever arm 5, as shown in FIG. 4.

Figure 6:
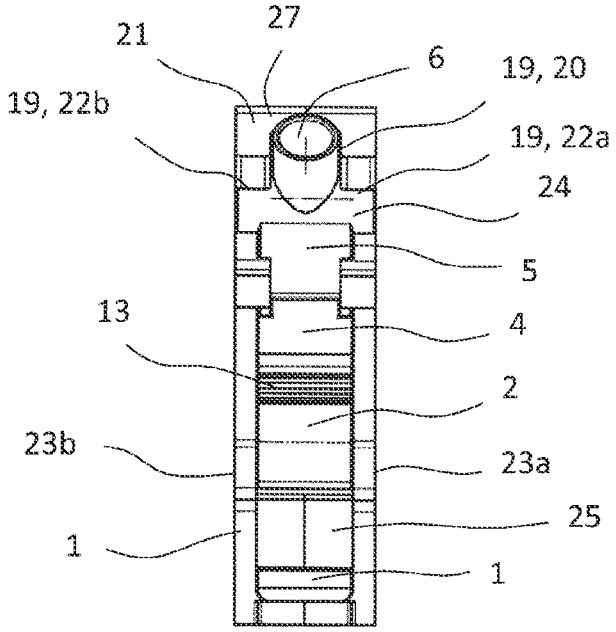
FIG. 6 is a schematic view of the connecting terminal shown in FIGS. 2 and 5 having a closed receiving body.
Figure 7:
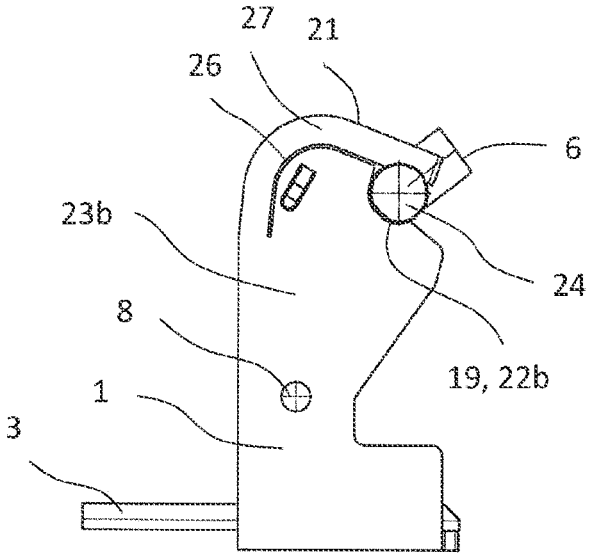
FIG. 7 is an additional schematic view of the connecting terminal shown in FIGS. 2 and 5 having a closed receiving body.
Figure 8:
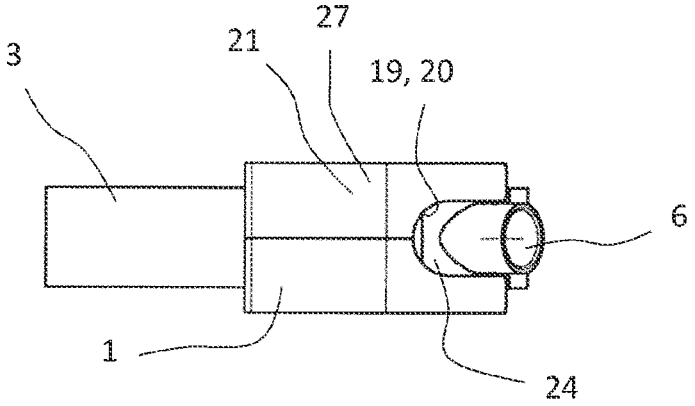
FIG. 8 is a schematic plan view of an upper side of the connecting terminal shown in FIG. 7.

The receiving body 1 is shown closed in FIGS. 6 to 8, wherein FIG. 6 is a plan view of the transverse side 21 of the receiving body 1, FIG. 7 is a plan view of the longitudinal side 23*b* of the receiving body 1 and FIG. 8 is a plan view of the transverse side 21 of the receiving body 1.

As can be seen in FIG. 7, a groove 26 is formed in each of the longitudinal sides 23*a*, 23*b*, wherein only the groove 26 in the longitudinal side 23*b* can be seen in this case, although a corresponding groove 26 is also formed in the longitudinal side 23*a* in a mirror image of said other groove. The grooves 26 are formed in an upper region of the receiving body 1 where the second lever arm 5 is guided on the receiving body 1. The grooves 26, each of which opens up into the openings 22*a*, 22*a* in the longitudinal sides 23*a*, 23*b*, allow the region 27 of the transverse side 21 of the receiving body 1, which region forms the upper side of the receiving body 1 and is where the opening 20 is formed in the transverse side 21, to be resilient, as a result of which it is possible to prevent damage to the receiving body 1, during movement from the non-clamping position into the clamping position, due to the actuation region 6 of the second lever arm 5 striking the receiving body 1 inside the opening 20 as a result of the spring action of the resilient region 27 of the receiving body 1. Each of the grooves 26 in the longitudinal sides 23*a*, 23*b* are substantially C-shaped and therefore match the contour of the receiving body 1.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Receiving body 1
Clamping element 2
Busbar 3
First lever arm 4
Second lever arm 5
Actuation region 6
End face 7
Rotary pin 8
Hole 9
First end 10
Clamping arm 11
Second end 12
Latching lug 13
Recess 14
First end 15
Second end 16
End 17
Recess 18
Guide region 19
Opening 20
Transverse side 21
Opening 22*a*, 22*b*
Longitudinal side 23*a*, 23*b*
Guide element 24
Opening 25
Groove 26
Resilient region 27

The invention claimed is:

1. A connecting terminal comprising:

a clamping element configured to clamp a conductor inserted into the connecting terminal against a busbar arranged in the connecting terminal so as to provide an electrical connection between the conductor and the busbar;

a receiving body in which the clamping element is disposed;

a first lever arm rotatably mounted on the clamping element; and a second lever arm rotatably mounted on the first lever arm, wherein the second lever arm has an actuation region by which the second lever arm can be pivoted, and wherein the clamping element can be moved by the first lever arm into a clamping position and into a non-clamping position when the second lever arm is pivoted.

2. The connecting terminal according to claim 1, wherein the actuation region has a form of a tool insertion opening.

3. The connecting terminal according to claim 1, wherein when the clamping element is moved into the clamping position and into the non-clamping position, the second lever arm carries out a first pivot movement and the clamping element carries out a second pivot movement, the first pivot movement and the second pivot movement being in opposite directions.

4. The connecting terminal according to claim 1, wherein the receiving body has a guide region in which the second lever arm is guided when the second lever arm is pivoted.

5. The connecting terminal according to claim 4, wherein the second lever arm has a guide element which engages in the guide region of the receiving body.

6. The connecting terminal according to claim 4, wherein the receiving body has a resilient region, the resilient region adjoining the guide region of the receiving body.

7. The connecting terminal according to claim 1, wherein the clamping element comprises a clamping arm having one or more latching lugs for clamping the inserted conductor.

8. The connecting terminal according to claim 1, wherein the clamping element is pivotally mounted by a rotary pin arranged on the receiving body.

* * * * *